US005370141A

United States Patent [19]

Gueret

[11] Patent Number: 5,370,141

[45] Date of Patent: Dec. 6, 1994

[54] BRUSH WITH FEW BRISTLES FOR APPLYING MASCARA TO THE EYELASHES

[75] Inventor: Jean-Louis H. Gueret, Paris, France

[73] Assignee: L'Oreal, Paris, France

[21] Appl. No.: 87,763

[22] PCT Filed: Dec. 16, 1992

[86] PCT No.: PCT/FR92/01187

§ 371 Date: Jul. 13, 1993

§ 102(e) Date: Jul. 13, 1993

[87] PCT Pub. No.: WO92/13690

PCT Pub. Date: Jul. 22, 1993

[30] Foreign Application Priority Data

Jan. 8, 1992 [FR] France ..... 92 00132

[51] Int. Cl.[5] ..... A45D 40/26

[52] U.S. Cl. ..... 132/218; 132/320; 15/206; 15/207.2

[58] Field of Search ..... 15/160, 206, 207.2; 132/216, 218, 317, 318, 320

[56] References Cited

U.S. PATENT DOCUMENTS

| | | | |
|---|---|---|---|
| 2,728,929 | 1/1956 | Bell | 15/206 |
| 4,617,948 | 10/1986 | Gueret | 132/218 |
| 4,733,425 | 3/1988 | Hartel et al. | 132/218 |
| 4,861,179 | 8/1989 | Schrepf et al. | 132/218 |
| 4,887,022 | 12/1989 | Gueret | 132/320 |
| 4,898,193 | 2/1990 | Gueret | 132/218 |
| 4,927,281 | 5/1990 | Gueret | 132/218 |
| 4,993,440 | 2/1991 | Gueret | 132/218 |
| 5,063,947 | 11/1991 | Gueret | 132/218 |
| 5,197,497 | 3/1993 | Gueret | 132/218 |

FOREIGN PATENT DOCUMENTS 2607373 6/1988 France .

*Primary Examiner*—Mark Spisich

*Attorney, Agent, or Firm*—Cushman, Darby & Cushman

[57] ABSTRACT

A brush for applying mascara to the eyelashes is formed by a central core formed from a twisted metal wire 1 the twists of which trap between them the bristles 2 of the brush, the said bristles 2 being disposed in a substantially uniform manner between the twists, characterised in that the bristles 2 have a substantially solid circular cross section the diameter of which is between 0.12 and 0.25 mm, the number of bristles 2 per turn being between 5 and 9, the said bristles substantially forming a single spiral layer in which each bristle is disposed substantially radially, the angle between two adjacent bristles of the layer being substantially constant to within approximately 20%.

21 Claims, 2 Drawing Sheets

BRUSH WITH FEW BRISTLES FOR APPLYING MASCARA TO THE EYELASHES

FIELD OF THE INVENTION

This invention relates to a brush intended for making up the eyelashes by means of a product for thickening the eyelashes, also referred to as mascara.

BACKGROUND OF THE INVENTION

The usual brushes of this type generally comprise relatively long bristles disposed in a spiral layer around a core formed by a twisted iron wire. The number of bristles of the brush is measured by the number of bristles forming one turn of the spiral layer having an angular aperture equal to 360°.

Relatively flexible bristles were used in the prior art so as to give the brush the general property of appropriate flexibility. Given that the brush was to be used to make up a support as delicate as the eyelashes, the maximum diameter of the bristles was generally approximately 0.08 mm. The bristles used were generally made of polyamide. In this case, given that the bristles of small diameter referred to hereinabove have in themselves very low rigidity, it was ensured that a sufficient quantity of mascara was taken up and that the eyelashes were brushed correctly at the time of application by always using more than 50 bristles per turn so that the spiral layer was sufficiently thick to obtain the desired result. The spiral layer of bristles generally had a pitch of approximately 2 mm and the bristles were substantially parallel in the thickness of the layer.

However, it became clear that brushes of this kind did not ensure good distribution of the make-up product over the eyelashes upon use, as, in practice, the mascara is often placed over the eyelashes in blobs with no homogeneity, so that the user has to effect repeated brushing operations until an approximately uniform coating of the eyelashes is obtained. This disadvantage results firstly from the fact that these brushes comprise a large number of bristles packed closely together in the spiral layer, so that, at the time of application, the eyelashes, the diameter of which is generally between 0.08 and 0.12 mm, cannot traverse the layer of bristles and can only move into the gaps between the successive turns of the spiral layer of bristles. The eyelashes therefore cannot be separated from one another at the time of application, as would be desirable. However, the said disadvantage results moreover secondly from the fact that when a brush of this kind of the prior art takes up the mascara, the latter is distributed poorly over the brush, as a mascara applicator generally comprises a mascara container and a removable cap which is adapted to close the container and which forms a handle for the manipulation of a make-up brush carried by the end of a stem integral with the said cap. In the closed position of the container, the stem and the brush associated therewith penetrate into the container. When the stem is removed from the container, a certain quantity of mascara is taken up on the brush and this can then be applied to the eyelashes. The brush penetrates into the interior of the container via a substantially circular orifice surrounded by a flexible lip, the function of which is to exert a wiping action on the bristles of the brush in order to eliminate excess make-up product taken up on the brush inside the container. The diameter of this circular orifice is smaller than the diameter of the brush measured at the tip of the bristles, so that the flexible lip which surrounds the orifice can exert its wiping action when the brush is removed from the container. As the bristles of the brush are relatively flexible and are disposed with a relatively high density in the spiral layer of bristles, they bend over in the direction of the core when the layer passes through the wiper lip and, by virtue of this deformation, they cause the bristles of the adjacent turn to "bend over", resulting in the fact that the make-up product tends to accumulate in the region of the brush situated just around the core. Under these conditions, at the time of application, the user will have difficulty obtaining a completely uniform and homogeneous coating of the eyelashes by the make-up product in one single passage of the brush, the make-up product gradually migrating towards the ends of the bristles initially not heavily loaded with product. Migration of this kind is moreover effected in a random manner. This results in heterogeneous and generally light make up.

An improved make-up brush obviating the aforesaid disadvantages was already proposed in French Patent No. 2 607 373. It was proposed to use bristles of a larger diameter and to ensure that these bristles had a greater spacing from one another by using a small number of bristles per turn. The brush proposed in this manner thus consists of more thinned out and harder bristles. It is harder to the touch, but nevertheless does not give the impression of hardness during making up. The reduction in the number of bristles per turn means that it is possible for the bristles of the spiral layer situated substantially in one single radial plane of the brush to adopt at random, starting from the zone in which they are gripped between the turns, an angular spacing from the iron wire which forms the core relative to the mean spiral surface of the spiral layer of bristles. In other words, the edge of the spiral layer of bristles becomes all the wider the more the number of bristles per turn is reduced. It has been noted that it was possible in this manner to obtain brushes the spiral layer of which became virtually invisible, the bristles of one turn of the spiral layer being able to come into the vicinity of the bristles of the adjacent turn of the same spiral layer as a result of the random angular spacing adopted by the bristles in their gripped zone. This particular result is obtained when the bristles have a diameter of between 0.10 and 0.25 mm and when the number of bristles per turn is between 10 and 40. It has been noted that these improved brushes improve the uniformity of the loading with make-up product of the bristles of the brush from their base to their tip and moreover improve the combing of the eyelashes during making up, as a result, on the one hand, of the greater firmness of the bristles, the diameter of which was increased and, on the other hand, of their spacing as a result of the disappearance of the spiral effect.

According to this invention, it was acknowledged that it was not possible to reduce the number of bristles of the brush to below 10 bristles per turn as a result of the fact that the "hedgehog" formed by a brush of this kind would not have been sufficient to allow for satisfactory making up, as the eyelashes could then traverse the brush virtually without touching a bristle loaded with product. This lower limit for the number of bristles of a brush was moreover generally acknowledged as a result of the fact that the person skilled in that art felt that the reduction in the number of bristles of a brush of the type defined hereinabove would always lead to the disappearance of the spiral effect and the emergence of a "hedgehog" type brush as a result of random angular spacing of the bristles relative to the mean spiral surface of the layer of bristles. It became clear, moreover, that this effect increased as the number of bristles per turn was reduced for a given bristle diameter.

SUMMARY OF THE INVENTION

It has now been found that, contrary to what was justifiably expected by the person skilled in the art, a new, quite unexpected phenomenon is produced when the number of bristles per turn of a brush of this kind is reduced to below 10, as it was noted that, according to the invention, in the case of bristles having a diameter of between 0.12 and 0.25 mm and with a core wire having a diameter of between 0.2 and 0.9 mm, the spiral effect reappeared when the number of bristles per turn is between 5 and 9. However, in such a case, in contrast to the brushes of the prior art in which the spiral layer of bristles comprises a plurality of bristles in its thickness, the spiral layer produced is a single layer of bristles each disposed substantially radially and defining a regular spiral surface. In a single layer of this kind, it has been noted that by using the conventional industrial process for the manufacture of brushes of this type, two adjacent bristles of the spiral surface form between them an angle which varies little, in particular by less than 20% from one bristle to the next on the surface.

This unexpected phenomenon is particularly advantageous when the number of turns per unit length of the brush and the outer brush diameter are selected in such a manner that the ends of the brush bristles are virtually all equidistant from one another, except for a small percentage of error, on the periphery of the brush. Of course it may be provided that this equidistance of the bristle ends is obtained solely for one zone of the brush, or that the brush comprises at least one conical zone, or that the brush is milled in one zone of its peripheral surface substantially included between two radial planes. In other words, the cross section of the peripheral surface of a brush of this kind can have any shape.

It will be recalled that the conventional industrial process for the manufacture of mascara brushes of this type consists, in a first stage, in folding an iron wire into a hairpin, in a second stage, in engaging a series of tufts of bristles between the two branches of the hairpin, these being brought into position by means of a comb the edge of which is formed by successive notches, the bristles of the brush being disposed in the said notches perpendicularly to the centre plane of the comb, and, in a third stage, in gripping the two ends of the hairpin loaded with tufts of bristles in this manner and in effecting relative rotation of the ends so as to form the turns of the iron wire which forms the core of the brush. In this relative rotation, the bristles, distributed in identical tufts over the entire length of the brush, slide over the core wire during twisting so that the final distribution of the number of bristles per turn is uniform from one end of the brush to the other.

This invention consequently relates to a brush for applying mascara to the eyelashes, formed by a core formed from a twisted metal wire the twists of which trap between them the bristles of the brush, the said bristles being disposed in a substantially uniform manner between the said twists, characterised in that the bristles have a cross section included in a circular envelope the diameter of which is between 0.12 and 0.25 mm, the number of bristles per turn being between 5 and 9, the said bristles substantially forming a single spiral layer in which each bristle is disposed substantially radially, the angle between two adjacent bristles of the layer being substantially constant to within approximately 20%.

The bristles of the brush according to the invention can have a cross section of any shape, in particular a circular, square, rectangular, hexagonal, octagonal or oval section.

In a preferred embodiment, the wire of the core has a diameter of between 0.2 and 0.9 mm. The pitch of a turn of the spiral layer is generally between 1.5 and 3.5 mm. The maximum diameter of the peripheral surface of the brush is advantageously between 5 and 12 mm. The peripheral surface of the brush is defined to be the surface on which all of the ends of the bristles of the brush are situated.

In a first embodiment, the peripheral surface of the brush is cylindroconical, conical, cylindrical or bud-shaped. The cross section of the peripheral surface of the brush is thus advantageously circular. In another embodiment, the cross section of the peripheral surface of the brush is defined, at least in certain zones of the brush, by a curve the distance of which from the outline of the core in the said cross section is not constant. In all cases, it is possible by virtue of the conventional manufacturing process to obtain a cylindrical brush the peripheral surface of which is shaped as desired by grinding and/or milling. In the brushes according to the invention, the ends of at least some of the bristles of the brush can therefore be ground so that they have the particular shapes that can be imparted to the bristle ends by grinding.

In a preferred embodiment, it is provided that, for at least one zone of the brush, the spacing of the ends of two adjacent bristles of the spiral layer of bristles is substantially equal to the pitch of one turn of the spiral layer of bristles in the said zone. Particularly in the case of a brush zone the peripheral surface of which is a cylinder of revolution, it is preferred for the number of bristles per turn to be constant. In the case of a brush zone the peripheral surface of which is a surface of revolution the cross section of which has a variable diameter, it can be provided that the number of bristles per turn is an increasing function of the said diameter. The dimensions of the brushes according to the invention are advantageously such that the minimum distance between the ends of 2 adjacent bristles is at least 0.8 mm, given that this distance can vary over one single brush according to the shape and dimensions of the peripheral surface of the said brush.

BRIEF DESCRIPTION OF THE INVENTION

The object of the invention will be more readily understood from the following description of one embodiment and its application given purely by way of a non-limiting example and illustrated in the accompanying drawings, in which:

FIG. 1 is a diagrammatic side view of a turn of a brush according to the invention comprising 9 bristles per turn, and FIG. 2 shows in diagrammatic form the comb on which the bristles are placed for the manufacture of the brush according to the invention and the hairpin wire which grips the bristles placed on the comb.

FIGS. 3*a*–3*f* are views of cross-sectional shapes for the bristles of this invention and FIGS. 3*g*–3*j* show shapes of the formed brush.

DETAILED DESCRIPTION OF THE INVENTION

Figure 1:
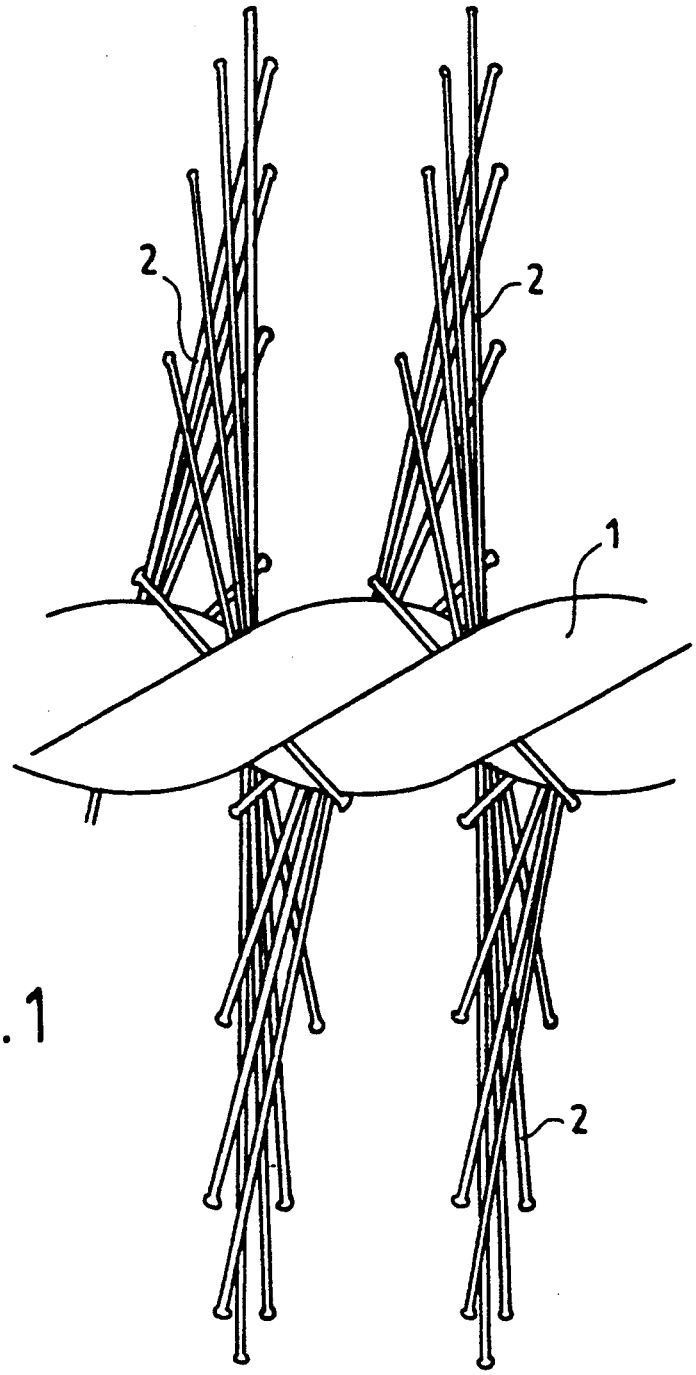
Figure 2:
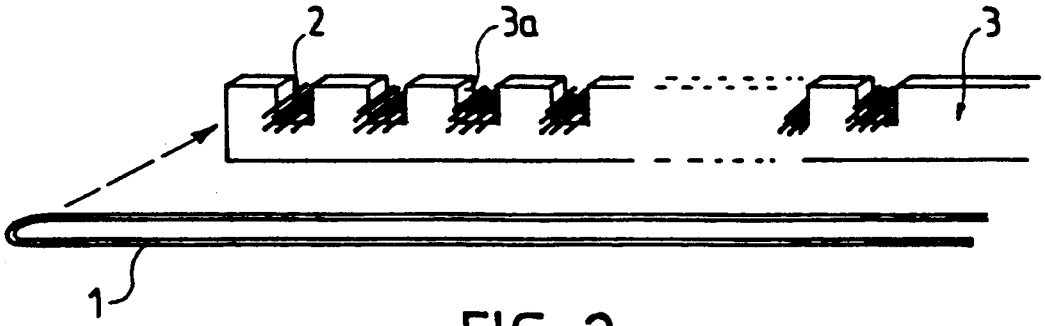
Figure 3A:
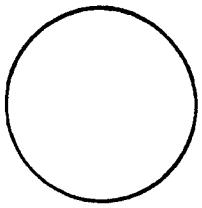
Figure 3B:
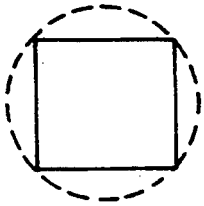
Figure 3C:
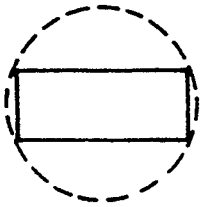
Figure 3D:
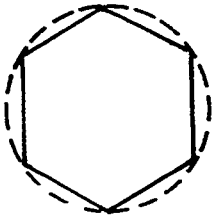
Figure 3E:
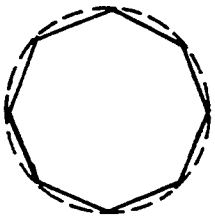
Figure 3F:
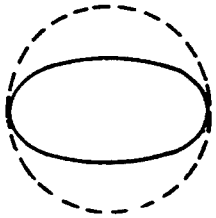
Figure 3G:
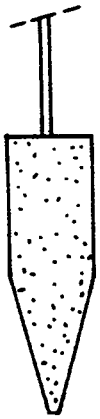
Figure 3H:
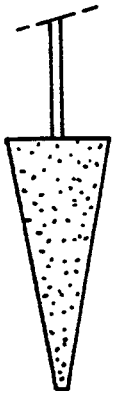
Figure 3I:
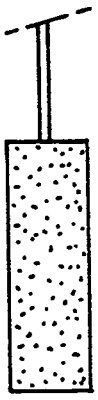
Figure 3J:
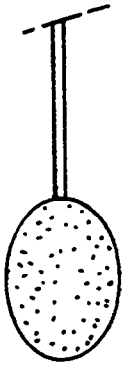

Referring to FIG. 1, it shows a brush comprising 9 bristles per turn. The core of the brush is foraged by one twist of an iron wire 1 with a circular cross section and a diameter of 0.5 mm. Bristles made of nylon 6, 10 having a solid circular cross section with a diameter of 0.15 mm are trapped in the iron wire twist via their central zone. Each bristle, designated by the reference numeral 2, is gripped in its central part by the twisted wire 1 and all of the bristles define a single spiral layer, the bristles being regularly spaced from one another, i.e. one bristle 2 forms with the adjacent bristles an angle which is constant to within approximately 20% all along the spiral layer formed.

A brush of this kind is manufactured by implementing a conventional manufacturing process used industrially for all types of brush having a twisted core. To this end, in a first stage, the core wire 1 is folded into a hairpin. Tufts of bristles 2 are placed in the notches 3*a* of a comb 3. The pin formed by the wire 1 is made to slide relative to the comb 3, so that the projecting parts of the tufts of bristles 2 are positioned between the two branches of the pin, the plane of the two branches of the pin being substantially the centre transverse plane of all of the tufts of bristles 2. The two ends of the pin formed by the wire 1 are then gripped, the comb is removed and relative rotation of the two ends of the pin is effected in order to create the twist which forms the core of the brush. In this twisting operation, the bristles are distributed regularly between the twisted wires, so that after twisting the brush has a uniform distribution of bristles even although at the outset the bristles had been positioned in tufts corresponding to each of the notches of the comb 3.

In this embodiment, the desired brush has a length of 26 mm. The comb 3 used consists of a steel blade having a thickness of 4 mm with 18 notches 3*a* each having a width of 1 mm, two successive notches being separated by rectangular teeth having a width of 0.7 mm. Approximately 12 bristles 2 each having a length of 20 mm are placed in each of the notches and then the procedure described hereinabove is carried out in order to obtain a brush according to the invention. This brush comprises 20 turns and 9 bristles per turn. Each turn of the spiral layer therefore occupies 0.5 mm over the length of the brush. After twisting has been effected, the brush is ground or trimmed in order to give it a cylindroconical shape, the cylindrical part of which forms the part of the peripheral surface having the maximum diameter. This maximum diameter is 7.5 mm. With the values given hereinabove for the different parameters, it will be noted that, over the cylindrical part of the brush, the ends of two adjacent bristles of the spiral layer are substantially 1.2 mm from one another. This spacing is substantially constant given that the bristles 2 are all disposed substantially radially and are spaced angularly from one another by a value of approximately 40°, the variation in this angle along the entire spiral layer being less than 20%.

The bristles of the brush are made of polyamide 6, 10 as indicated hereinbefore, but the bristles of the brush according to the invention can also be made of polyamide 6/6 or polyamide 6, 12 or polyamide 6 or polyamide 11 or polyester or polytetrafluoroethylene. These raw materials may or may not be provided with agents improving the sliding and wetting properties of the material.

It will therefore be noted that, in the brush according to the invention, the ends of the bristles 2 are substantially equidistant from one another over the cylindrical peripheral surface of the brush. It is of course clear that this equidistance is no longer respected over the conical part of the peripheral surface of the brush as the outer diameter of the brush decreases whereas the number of bristles per turn remains constant. In a variant, it could of course be envisaged to reduce the number of bristles per turn as the outer diameter of the brush is reduced over the conical part of the latter so as to preserve the equidistance of the ends of the bristles.

In FIGS. 3*a*–3*f*, are illustrated a variety of cross sectional shapes, all lying within a circular periphery for the individual bristles of the present invention comprising a smooth circle, a square, a rectangle, a hexagon, an octagon and an ellipse.

In FIGS. 3*g*–3*j*, there are illustrated schematic views of the shape of the formed brush which are formed by grinding the bristles once attached to the twisted core.

It has been noted that the make up obtained with a brush of this kind is of perfect quality as the eyelashes can penetrate between the bristles of the brush so that the brush ensures a combing action of the eyelashes. In addition, the load of mascara product is smooth over the entire length of the eyelash, taken separately, so that an eyelash-lengthening effect can be achieved. The load of make-up product over the eyelash can be high as the eyelash can penetrate into the brush as far as the vicinity of the core, i.e. into the zone of the brush wiped the least, and therefore into the zone in which the greatest quantity of make-up product is situated. Finally, by virtue of the constancy of the spacing of the bristles irrespective of the angle formed between the eyelashes and the axis of the brush, it is possible to obtain perfectly homogeneous make up.

I claim:

1. A brush for applying mascara to the eyelashes comprising a core including a metal wire having a plurality of twists along said core with said twists in said metal wire trapping bristles, said bristles being disposed in a substantially uniform manner between the twists of said metal wire, the bristles defining a peripheral surface having a cross-section included in a circular envelope having a diameter between 0.12 and 0.25 mm, the number of bristles per twist of said metal wire being from 5 to 9, said bristles substantially forming a single spiral layer in which each bristle extends substantially radially relative to said core with adjacent bristles extending with an angle therebetween, said angle between two adjacent bristles of said layer being substantially constant to within approximately 20%.

2. Brush according to claim 1, wherein the cross section of the bristles is circular.

3. Brush according to claim 1, characterised in that the wire of the core has a diameter of between 0.2 and 0.9 mm.

4. Brush according to claim 1, characterised in that the peripheral surface of the brush is cylindroconical.

5. Brush according to claim 4, characterised in that the cross section of the peripheral surface of the brush is circular.

6. Brush according to claim 4, characterised that the peripheral surface of the brush is defined, at least in certain portions of the brush, by a curve the distance of which from the core in the peripheral surface varies.

7. Brush according to claim 6, characterised in that, for at least one portion of the brush, the spacing of the ends of two adjacent bristles of the spiral layer of bristles is substantially equal to the pitch of one turn of the spiral layer of bristles at least one in the said portion.

8. Brush according to claim 7, characterised in that the number of bristles per turn is constant.

9. Brush according to claim 7, in which the peripheral surface of one portion of the brush is a surface of revolution the cross section of which has a variable diameter, characterised in that the number of bristles per turn in the said one portion is an increasing function of the said diameter.

10. Brush according to claim 9, characterised in that the ends of at least some of the bristles of the brush are ground.

11. Brush according to claim 10, characterised in that the ends of two adjacent bristles of the brush are more than 0.8 mm apart.

12. The brush as claimed in claim 1, wherein said spiral layer displays a pitch defined by the tips of the bristles of said layer, said pitch being between 1.5 and 3.5 mm.

13. The brush as claimed in claim 1, wherein the cross section of the bristles is square.

14. The brush as claimed in claim 1, wherein the cross section of the bristles is rectangular.

15. The brush as claimed in claim 1, wherein the cross section of the bristles is hexagonal.

16. The brush as claimed in claim 1, wherein the cross section of the bristles is octagonal.

17. The brush as claimed in claim 1, wherein the cross section of the bristles is oval.

18. The brush as claimed in claim 1, wherein the peripheral surface of the brush is conical.

19. The brush as claimed in claim 1, wherein the peripheral surface of the brush is cylindrical.

20. The brush as claimed in claim 1, wherein the peripheral surface of the brush is conical.

21. The brush as claimed in claim 1, wherein the peripheral surface of the brush is bud-shaped.

* * * * *